US012715558B2

(12) United States Patent
Jaccard

(10) Patent No.: US 12,715,558 B2
(45) Date of Patent: Aug. 25, 2026

(54) UNDERWATER DOCKING SYSTEM FOR UNMANNED UNDERWATER VEHICLE

(71) Applicant: The United States of America, as represented by the Secretary of the Navy, Arlington, VA (US)

(72) Inventor: Gregory A Jaccard, San Diego, CA (US)

(73) Assignee: United States of America, as represented by the Secretary of the Navy, Washington, DC (US)

( * ) Notice: Subject to any disclaimer, the term of this patent is extended or adjusted under 35 U.S.C. 154(b) by 237 days.

(21) Appl. No.: 18/805,791

(22) Filed: Aug. 15, 2024

(65) Prior Publication Data

US 2026/0070633 A1 Mar. 12, 2026

(51) Int. Cl.

| | |
|---|---|
| ***B63B 35/40*** | (2006.01) |
| ***B63G 8/00*** | (2006.01) |
| ***B63G 8/04*** | (2006.01) |
| ***B63G 8/08*** | (2006.01) |

(52) U.S. Cl.

CPC ..... *B63B 35/40* (2013.01); *B63G 8/04* (2013.01); *B63G 8/08* (2013.01); *B63G 2008/008* (2013.01)

(58) Field of Classification Search

CPC .. B63B 35/40; B63G 8/08; B63G 8/04; B63G 2008/008

See application file for complete search history.

(56) References Cited

U.S. PATENT DOCUMENTS

| | | | | |
|---|---|---|---|---|
| 3,508,510 A * | 4/1970 | Frankel | B63B 35/40 114/260 |
| 6,779,475 B1 * | 8/2004 | Crane | B63B 27/10 114/259 |
| 10,065,719 B1 * | 9/2018 | Hoover | B63G 8/39 |
| 2022/0258841 A1 * | 8/2022 | Hooper | B63B 27/08 |

FOREIGN PATENT DOCUMENTS

| | | | |
|---|---|---|---|
| CN | 106314732 A * | 1/2017 | B63G 8/001 |
| CN | 111232133 A * | 6/2020 | B63G 8/001 |
| RU | 2848087 C1 * | 10/2025 | B63G 8/32 |

* cited by examiner

*Primary Examiner* — Timothy D Collins

(74) *Attorney, Agent, or Firm* — Naval Information Warfare Center, Pacific; Kyle Eppele; Andrew J. Cameron

(57) ABSTRACT

An underwater docking system for an unmanned underwater vehicle (UUV) includes a housing structure, a motorized drive assembly, and a drive control system. The housing structure is configured to at least partially enclose and house the UUV. The motorized drive assembly is disposed on an interior of the housing structure and is positioned to frictionally engage with a surface of the UUV when the UUV is within the housing structure. The drive control system is configured to selectively activate the motorized drive assembly to apply an egress translational force to the surface of the UUV to at least partially assist an egress of the UUV out of the housing structure.

20 Claims, 13 Drawing Sheets

UNDERWATER DOCKING SYSTEM FOR UNMANNED UNDERWATER VEHICLE

FEDERALLY-SPONSORED RESEARCH AND DEVELOPMENT

The United States Government has ownership rights in one or more inventions provided in this disclosure. Licensing inquiries may be directed to Office of Research and Technical Applications, Naval Information Warfare Center Pacific, Code 72110, San Diego, CA, 92152; (619) 553-5118; NIWC_Pacific_T2@us.navy.mil. Reference Navy Case No. 210899.

TECHNICAL FIELD

Aspects of the present disclosure relate generally to docking systems for an unmanned underwater vehicle (UUV), and in particular but not exclusively, relate to UUV docking systems with assisted launch and/or recovery mechanisms.

BACKGROUND OF THE INVENTION

Unmanned Underwater Vehicles (UUV) have seen increased maritime uses (e.g., oceanographic, scientific, oil and gas, defense, etc.), especially with the proliferation of advanced UUV technology, capabilities, and reduced costs. UUVs may be delineated by size and weight class and further subdivided into remotely operated vehicles (ROV) and autonomous underwater vehicles (AUV). These types of UUVs have numerous uses and their utility may be greatly expanded if they are able to interface intermittently with a docking system to transfer data, power, and/or perform other functions. However, some docking system designs require the UUV to drive under its own power to move the UUV into or out of the docking system. This can limit the effectiveness and reliability of these types of operations if conducted remotely or autonomously. Furthermore, the physical design of the UUV or the docking system, and/or the domain in which the docking system is deployed may impose several difficulties in effectively launching and recovering the UUV.

BRIEF DESCRIPTION OF THE DRAWINGS

Non-limiting and non-exhaustive embodiments of the invention are described with reference to the following figures, wherein like reference numerals refer to like parts throughout the various views unless otherwise specified.

DETAILED DESCRIPTION

Embodiments of an underwater docking system and a method for assisted egress and/or ingress of an unnamed underwater vehicle (UUV) are described herein. In the following description, numerous specific details are set forth to provide a thorough understanding of the embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As mentioned above, the physical design of the UUV, the physical design of the associated docking system, as well as the domain in which the docking system is deployed may impose several difficulties in effectively launching and recovering the UUV.

Figure 1A:
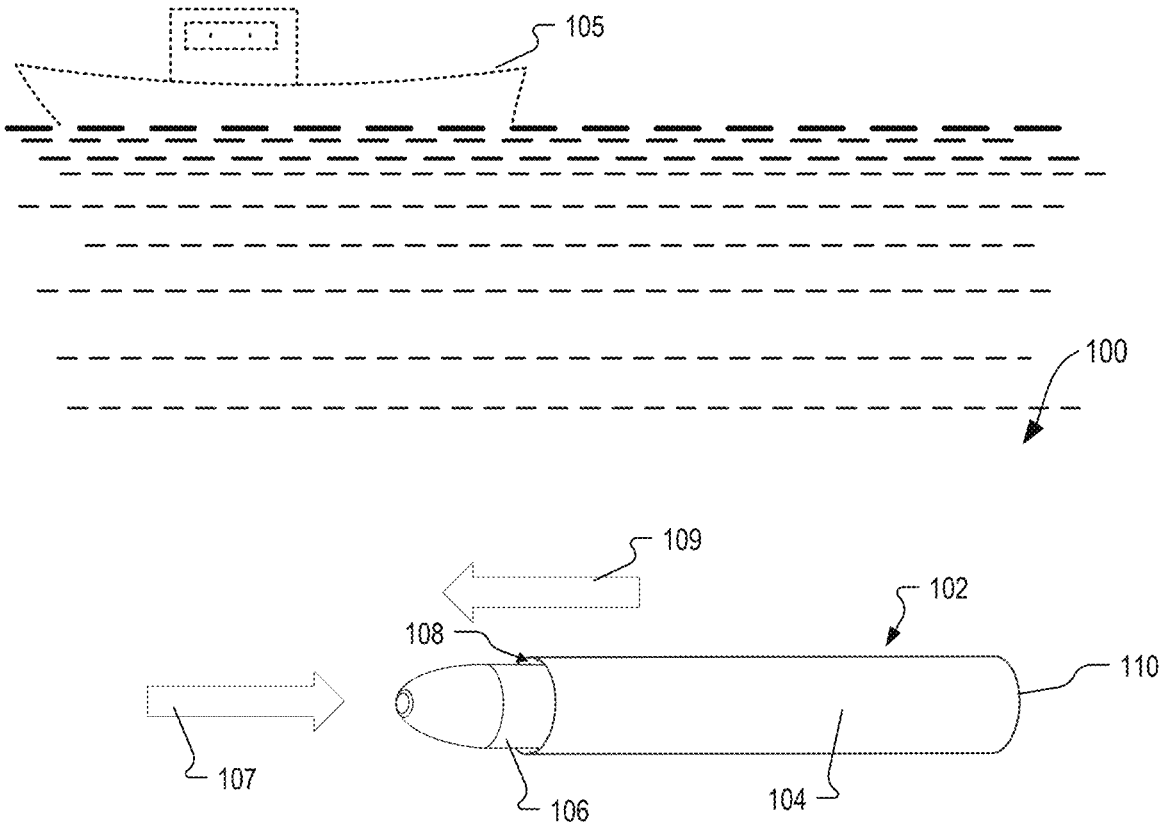
FIG. 1A illustrates an example underwater docking system deployed in an underwater domain, in accordance with aspects of the disclosure.
Figure 1B:
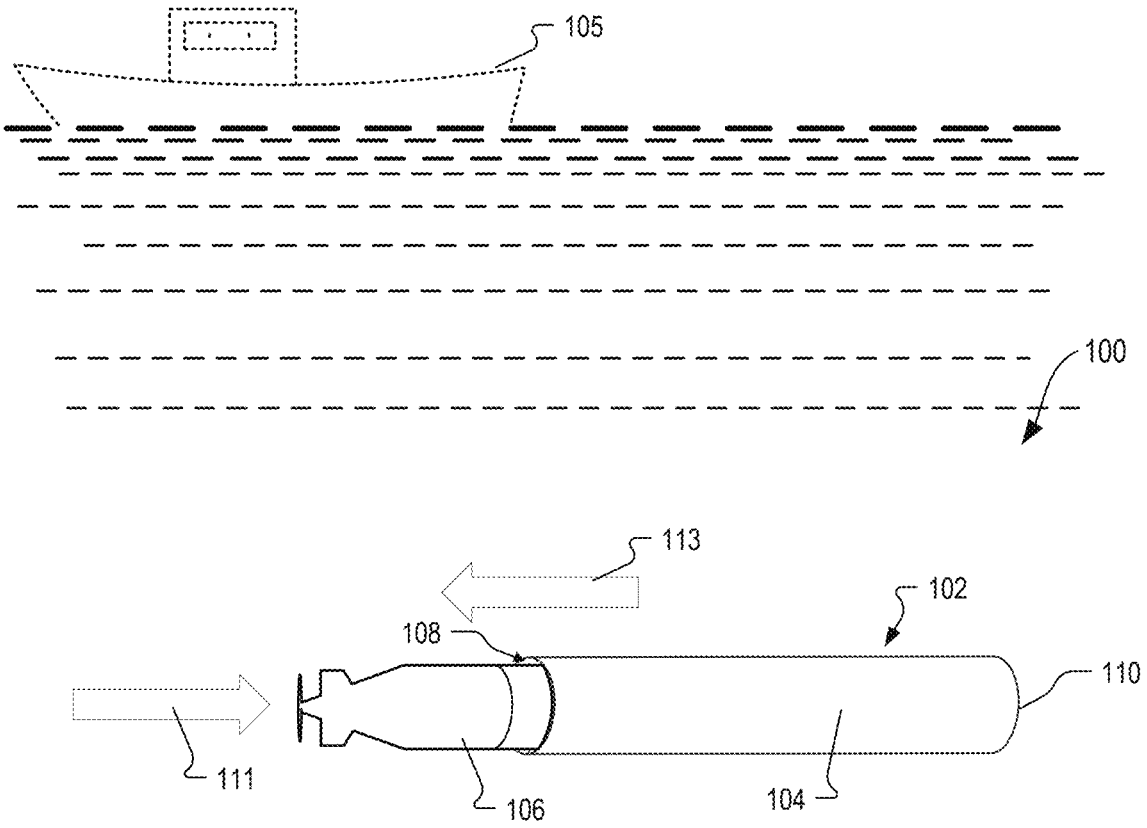
FIG. 1B illustrates another example underwater docking system deployed in the underwater domain, in accordance with aspects of the disclosure.

For example, FIGS. 1A and 1B illustrates an example underwater docking system 102 deployed in an underwater domain 100, in accordance with aspects of the disclosure. Underwater docking system 102 is shown as including a housing structure 104 that is configured to at least partially enclose and house a UUV 106 while the underwater docking system 102 and UUV 106 are underwater. Housing structure 104 is shown as including an open end, referred to herein as a dock aperture 108. Housing structure 104 is also shown as including an optional closed end 110.

In some aspects, the housing structure 104 includes a reduced or minimal volume and/or cross-sectional area of an interior of the housing structure 104, itself. Even still, in some examples the docking structure 104 is size/volume-constrained with a relatively low profile to accommodate a relatively large UUV 106. In some aspects, the housing structure 104 has a maximum interior cross-sectional area that is only slightly, or minimally, larger than a largest cross-sectional area of UUV 106. Such size and volume constraints on the housing structure 104 may impose difficulties and/or inefficiencies in moving UUV 106 into and out of the housing structure 104.

For example, FIG. 1A illustrates an opposite force 107 that is imposed against the UUV 106 during an egress of the UUV 106 out of the housing structure 104. Force 107 may include a frictional force incurred by UUV 106 due to physical contact between the UUV 106 and the housing structure 104 during egress. By way of another example, opposite force 107 may include a minimum force necessary to decouple the UUV 106 from one or more electrical connectors. For instance, underwater docking system 102 may be configured to transfer data and/or electrical power with the UUV 106 through a physical connection between the housing structure 104 and the UUV 106. For instance, the physical connection may be a magnetically-attached electrical connector, a frictionally-attached electrical connector, a spring-loaded electrical connector, or any other electrical connector for the transfer of data and/or power between the UUV 106 and the housing structure 104, where the decoupling (i.e., disconnecting) of the electrical connector is achieved by egressing the UUV 106 out of the housing structure 104.

Force 107 may also include a hydrodynamic force due to contact between the UUV 106 and the surrounding water of underwater domain 100, as UUV 106 exits the housing structure 104. In yet another example, force 107 may include a hydraulic force (e.g., piston or suction). In some aspects, the hydraulic force may be due to the limited free-flow of water through housing structure 104 (e.g., due to closed end 110) and/or may be due to the small size of the dock aperture 108 relative to a cross-sectional area of UUV 106. Even still, in some aspects, the small cross-sectional area of the interior of the housing structure 104 may prevent or at least limit the ability of UUV 106 to self-propel out of the housing structure 104 due to a limited water volume and free water space within housing structure 104.

FIG. 1A also illustrates an egress translational force 109. In some aspects, the egress translational force 109 is a minimal force necessary to overcome the opposite force 107 to allow the UUV 106 to egress out of the housing structure 104. As mentioned above, UUV 106 may include one or more propulsors and/or propellers for self-propulsion of the UUV 106. However, UUV 106 may be battery operated with limited energy storage. Thus, UUV 106 may be designed and operated with a significant portion of its onboard energy reserved for thrusting the UUV 106 through the water during normal operations.

Accordingly, underwater docking system 102 may include a motorized drive assembly (not explicitly shown in FIG. 1A) to assist in the egress of UUV 106 out of the housing structure 104. In some aspects, underwater docking system 102 provides the entire egress translational force 109 needed to egress UUV 106 out of the housing structure 104. In another example, the underwater docking system 102 provides egress translational force 109 that when combined with any egress translational force enacted by UUV 106, itself (e.g., propulsor of UUV 106), together are greater than the opposite force 107.

In some aspects, underwater docking system 102 may also assist in the ingress of UUV 106 into the housing structure 104. As shown in FIG. 1B, an opposite force 113 may be imposed against the UUV 106 during an ingress of the UUV 106 into the housing structure 104. Force 113 may include a frictional force incurred by UUV 106 due to physical contact between the UUV 106 and the housing structure 104 during ingress. Force 113 may also include a hydrodynamic force due to contact between the UUV 106 and the surrounding water during ingress. In yet another example, force 113 may include a hydraulic force (e.g., piston). In some aspects, the hydraulic force may be due to the limited free-flow of water through housing structure 104 (e.g., due to closed end 110) and/or may be due to the small size of the dock aperture 108 relative to a cross-sectional area of UUV 106. Even still, in some aspects, the small cross-sectional area of the interior of the housing structure 104 may prevent or at least limit ability of UUV 106 to self-propel into the housing structure 104 due to a limited water volume and free water space within housing structure 104.

Accordingly, the motorized drive assembly of underwater docking system 102 may be configured to assist in the ingress of UUV 106 into the housing structure 104. FIG. 1B illustrates an example ingress translational force 111. In some aspects, the ingress translational force 111 is a minimal force necessary to overcome the opposite force 113 to allow the UUV 106 to ingress into the housing structure 104. In some aspects, underwater docking system 102 provides the entire ingress translational force 111 needed to ingress UUV 106 into the housing structure 104. In another example, the underwater docking system 102 provides ingress translational force 111 that together with any ingress translational force enacted by the UUV 106 (e.g., self-propulsion of UUV 106) is greater than the opposite force 113.

Figure 1C:
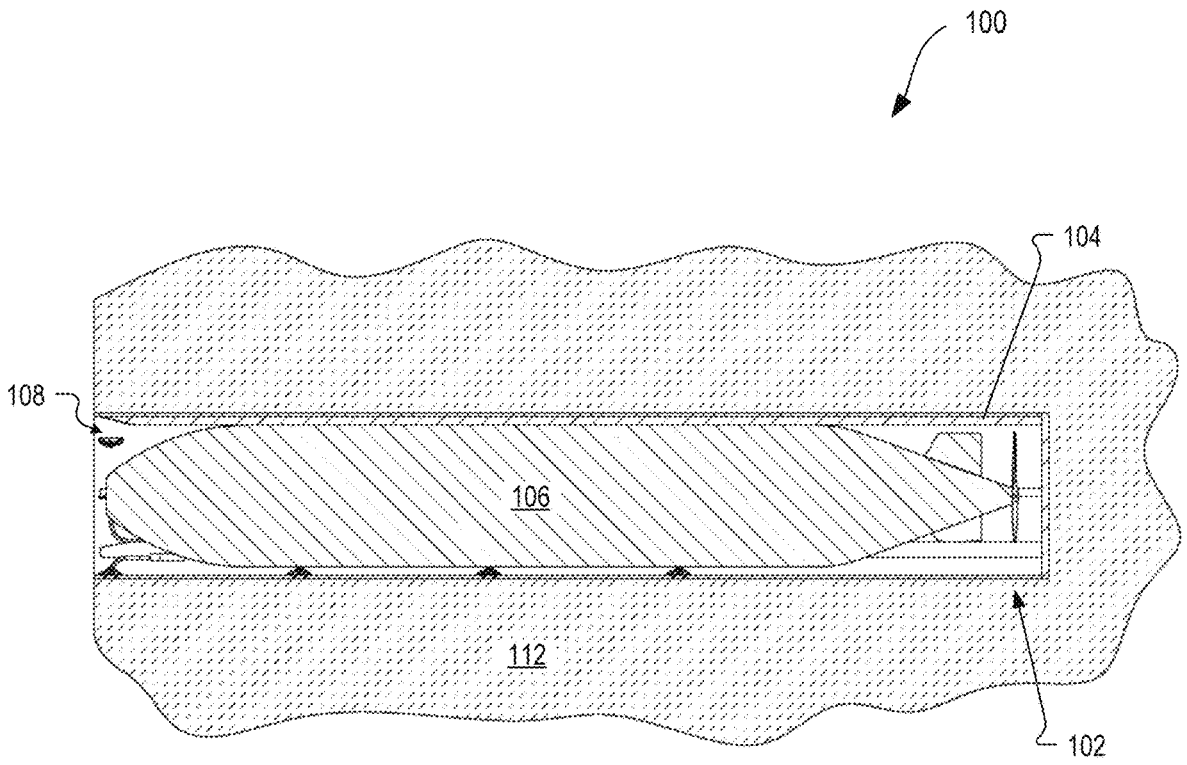
FIG. 1C illustrates an example underwater docking system disposed in a water-obstructed medium within the underwater domain, in accordance with aspects of the disclosure.

In some implementations, underwater docking system 102 may be incorporated with or housed within another platform. For example, FIG. 1C illustrates the housing structure 104 of underwater docking system 102 that is disposed in a water-obstructed medium 112. Water-obstructed medium 112 may include a solid material, such as the hull material (e.g., metal, fiberglass, etc.) of a ship, such as ship 105 of FIGS. 1A and 1B. The water-obstructed medium 112 may obstruct or prevent the free-flow of water in or immediately surrounding the housing structure 104, which further inhibits the ability of UUV 106 to self-propel into and out of housing structure 104. Accordingly, the motorized drive assembly of underwater docking system 102 may be configured to assist in the ingress and/or egress of UUV 106 even when housing structure 104 is fully or at least partially surrounded by water-obstructed medium 112.

Figure 2:
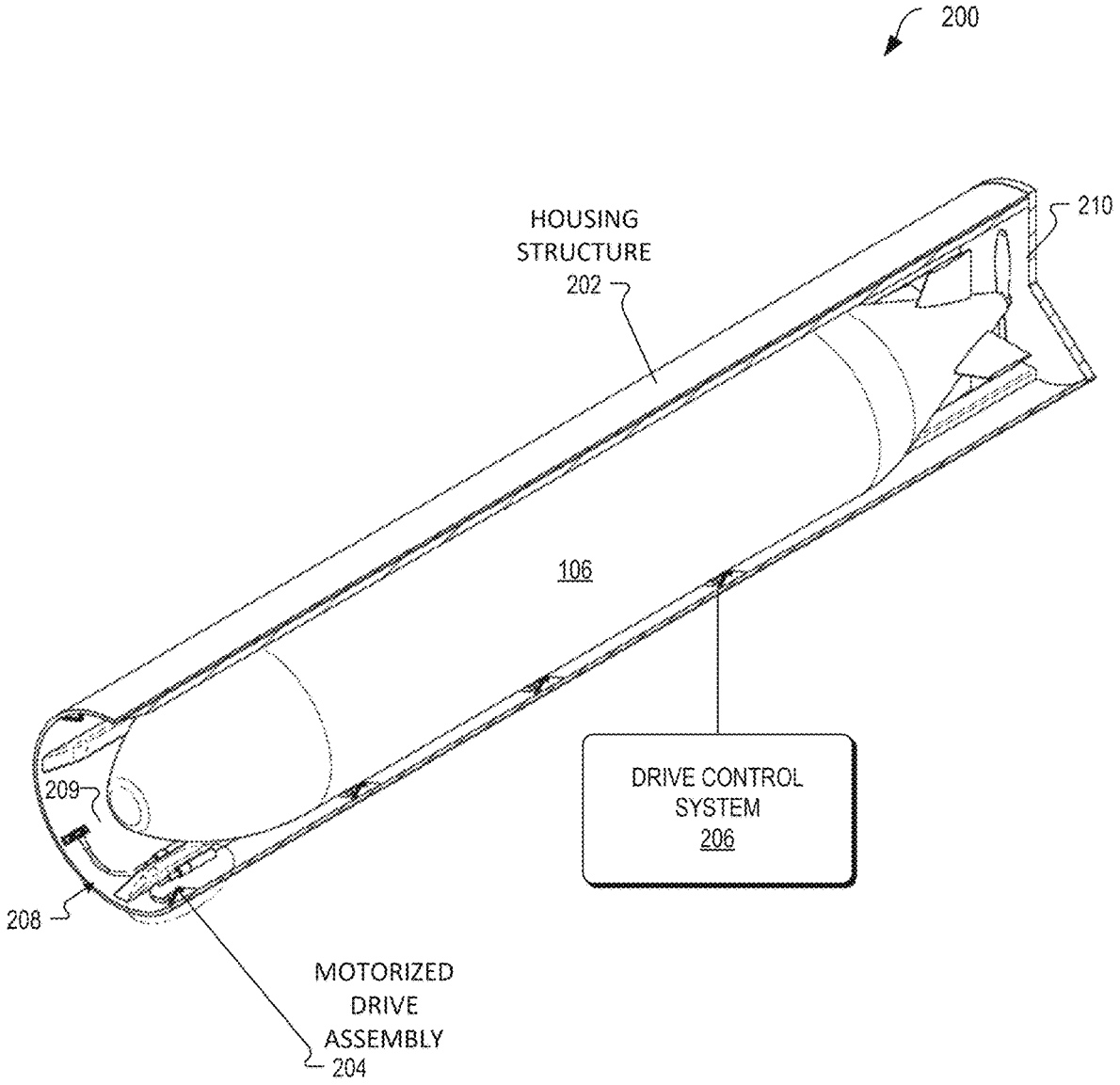
FIG. 2 illustrates an example underwater docking system, in accordance with aspects of the disclosure.

FIG. 2 illustrates an example underwater docking system 200, in accordance with aspects of the disclosure. Underwater docking system 200 is one possible implementation of the underwater docking system 102 of FIGS. 1A-1C. Underwater docking system 200 is shown as including a housing structure 202, a motorized drive assembly 204, a drive control system 206, a dock aperture 208, an interior 209, and a closed end 210.

In some examples, underwater docking system 200 is to be moored to a permanent or semi-permanent structure, such as a pier or a buoy. In other examples, underwater docking system 200 is to be anchored to the bed of a body of water (e.g., seabed). In yet another example, underwater docking system 200 may be incorporated with or attached to a moving platform, such as a ship or other vessel.

As shown in FIG. 2, underwater docking system 200 includes housing structure 202. In some implementations, housing structure 202 is a rigid material such as metal. Housing structure 202 is configured to at least partially enclose and house a UUV, such as UUV 106. In the illustrated example of FIG. 2, housing structure 202 has a circular cross-section that substantially conforms to the circular cross-section of UUV 106. However, in other examples, housing structure 202 may be configured to have a regular or irregularly-shaped cross-section depending on the cross-sectional shape of a corresponding UUV that is intended to be housed within housing structure 202 (e.g., oval, hexagonal, etc.). In some examples, the housing structure 202 includes a size-constrained volume. That is, the cross-sectional area of the interior 209 of housing structure 202 may be configured to be minimally or just slightly larger than an external cross-sectional area of UUV 106. In some aspects, the size-constrained volume of the interior 209 may limit or prevent the self-propulsion of UUV 106 within housing structure 202 due to limited water volume and free water space within interior 209.

As mentioned above, housing structure 202 includes a closed end 210 that may prevent the free flow of water through housing structure 202. In some examples, closed end 210 includes a hatch (not shown), or is otherwise removable, for access to the interior 209 of the housing structure 202. Dock aperture 208 may be sized and shaped to allow egress and/or ingress of the UUV 106 out of and into the housing structure 202. However, in some examples, dock aperture 208 may include a hatch (not shown) that is configured to fully enclose UUV 106 within the interior 209 of the housing structure 202.

FIG. 2 further illustrates an example motorized drive assembly 204 that is disposed on the interior 209 of housing structure 202. In some aspects, motorized drive assembly 204 is positioned on the interior 209 to frictionally engage with a surface of the UUV 106 when the UUV 106 is within the housing structure 202. As will be described in more detail below, the motorized drive assembly 204 may include a motor and one or more high-friction devices (e.g., rollers, tracks, etc.) that, when engaged, apply an egress translational force to the surface of the UUV 106 to at least partially assist in the egress of the UUV 106 out of the housing structure 202. Similarly, in some implementations, the motorized drive assembly 204 may be engaged to apply an ingress translational force to the surface of the UUV 106 to at least partially assist in the ingress of UUV 106 into the housing structure 202.

Further shown in FIG. 2 is a drive control system 206. Drive control system 206 may be communicatively coupled to the motorized drive assembly 204 to selective activate and deactivate the motorized drive assembly 204.

Figure 3:
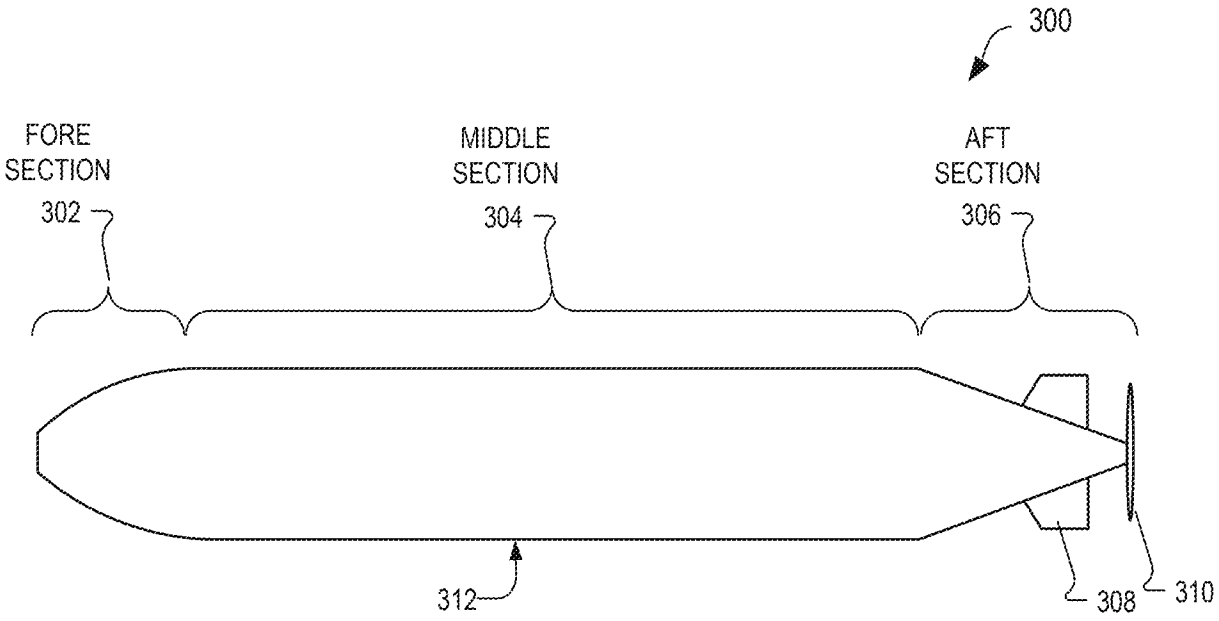
FIG. 3 illustrates an example unmanned underwater vehicle (UUV), in accordance with aspects of the disclosure.

FIG. 3 illustrates an example unmanned underwater vehicle (UUV) 300, in accordance with aspects of the disclosure. UUV 300 is one possible implementation of UUV 106 of FIGS. 1A-2. UUV 300 is shown as including a fore section 302, a middle section 304, an aft section 306, one or more control surfaces 308, and a propulsor 310. Also shown in FIG. 3 is a surface 312 of UUV 300.

In some examples, UUV 300 is a remote operated vehicle (ROV) and may be configured to allow real-time telemetry and user interaction. In some aspects, the UUV 300 is tethered to an independent control system (not shown) and/or is tethered to any of the underwater docking systems discussed herein. In other examples, UUV 300 is an autonomous underwater vehicle (AUV) that is untethered and configured to perform and operate with limited user intervention.

In one example, UUV 300 is faired over the entire external surface to minimize drag through the water. Furthermore, in order to improve reconfigurability with different onboard sensors, UUV 300 may have a constant-cross section except for the fore section 302 and the aft section 306, which may be faired to minimize drag. Propulsor 310 may be a propeller, an impeller, a thruster, or other means for self-propelling UUV 300 through a liquid, such as water.

Figures 4A, 4B:
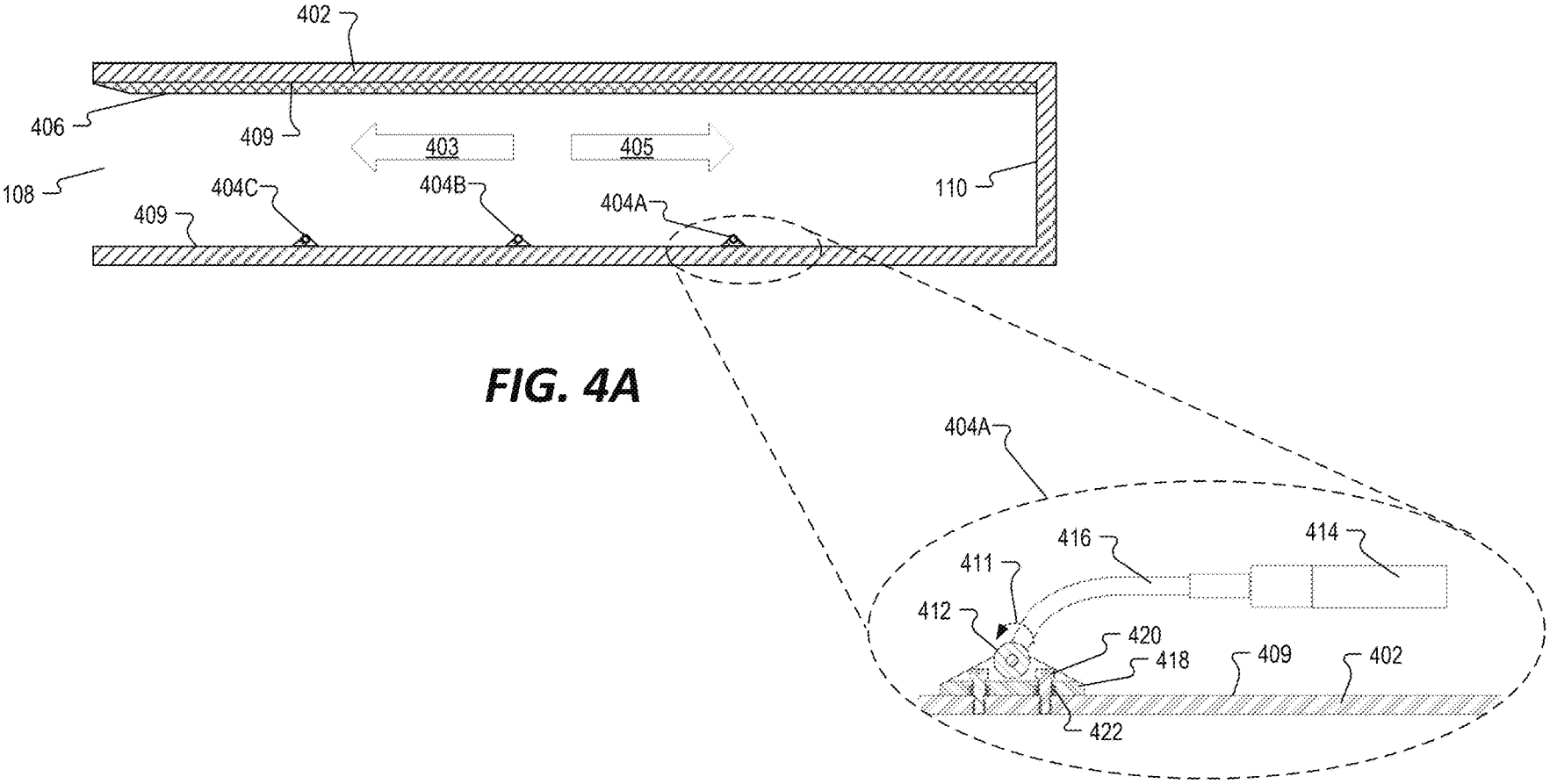
FIG. 4A illustrates an example housing structure of an underwater docking system, in accordance with aspects of the disclosure.
FIG. 4B is an expanded view of the housing structure of FIG. 4A illustrating an example motorized drive assembly that includes a high-friction device, in accordance with aspects of the disclosure.

FIG. 4A illustrates an example housing structure 402 of an underwater docking system, in accordance with aspects of the disclosure. Housing structure 402 is one possible implementation of housing structure 104 of FIGS. 1A-1C and/or housing structure 202 of FIG. 2. Housing structure 402 is shown as including dock aperture 108, closed end 110, motorized drive assemblies 404A, 404B, and 404C, and a guide rail 406.

As shown in FIG. 4A, guide rail 406 is disposed on an interior surface 409 of the housing structure 402 and is configured to support and align a UUV (e.g., UUV 300 of FIG. 3). In some examples, guide rail 406 is flared or bell-mouthed near the dock aperture 108 to allow for slight misalignments of the UUV during ingress of the UUV into housing structure 402. In some implementations, guide rail 406 is a marine-grade, low-friction material, such as nylon, polymer, acetal homopolymer, etc. Although FIG. 4A illustrates housing structure 402 as including a single guide rail 406, in other examples, housing structure 402 may include any number of guide rails including one or more that are circumferentially disposed on the interior 409 of housing structure 402. Similarly, although FIG. 4A illustrates housing structure 402 as including three motorized drive assemblies 404A-404C, housing structure 402 may include any number of motorized drive assemblies disposed on the interior 409 of the housing structure 402.

The motorized drive assemblies 404A-404C are positioned on the interior 409 of the housing structure 402. In some aspects, a motorized drive assembly (e.g., motorized drive assembly 404A) includes at least one motor and a high-friction device that is positioned to frictionally engage with a surface of the UUV. The motorized drive assemblies 404A-404C are configured to generate and apply an egress translational force 403 to the UUV to at least partially assist in the egress of the UUV out of the housing structure 402 through dock aperture 108. In some examples, the motorized drive assemblies 404A-404C may also be configured to generate and apply an ingress translational force 405 to at least partially assist in the ingress of the UUV into the housing structure 402 through dock aperture 108.

FIG. 4B is an expanded view of the housing structure 402 of FIG. 4A illustrating an example motorized drive assembly 404A that includes a high-friction device 412, in accordance with aspects of the disclosure. FIG. 4B illustrates high-friction device 412 as a high-friction roller. In some aspects, a high-friction roller includes rubber, polyurethane, or other material to frictionally contact a surface of the UUV to apply a translational force. In some examples, the high-friction roller may be configured to have a mechanical compliance that increases, or at least controls the frictional contact between the roller and the UUV. For instance, mechanical compliance of the high-friction roller may refer to the ability of the high-friction roller to deform or change shape in response to an applied force due to contact with the UUV. In another example, the surface geometry of the high-friction roller may be configured to increase, or at least control, the frictional contact with the surface of the UUV. In this example, the high-friction roller may include a surface geometry, such as a diamond pattern, raised rectangles, tread, or other raised shapes, configured to increase frictional contact with the UUV. In yet another example, the high-friction roller may include sand, silica, ceramic, or other embedded materials to provide an anti-slip surface that engages with the surface of the UUV. Also shown in FIG. 4B are a motor 414, a drive shaft 416, a base 418, a fastener 420, and a compression spring 422.

As shown in FIG. 4B, base 418 may be secured to an interior surface 409 of the housing structure 402 via one or more fasteners 420. In some examples, fasteners 420 may be a screw (e.g., shoulder screw), or a bolt. In some implementations, a compression spring 422 is included in the interface between the fastener 420 and base 418 to allow for slight misalignments between the UUV and the housing structure 402, as well as to provide a positive perpendicular force (e.g., up and down) between the high-friction device 412 and the UUV.

Motor 414 may be an electric motor that is activated in response to one or more control signals. In some aspects, a speed and/or direction of the motor 414 is controllable via the one or more control signals. In some examples, motor 414 may include a current limit switch to provide feedback signal regarding a present load on the motor 414. Motor 414 is shown as coupled to the high-friction device 412 via a drive shaft 416 to transfer mechanical power generated by motor 414 to a rotational movement 411 of the high-friction device 412. However, in other examples, motor 414 may be a direct-drive motor that is coupled directly to the high-friction device 412. Motorized drive assembly 404A may also include one or more clutches or other mechanisms for driving the rotational movement 411 of high-friction device 412. In some examples, drive shaft 416 is a flexible drive shaft to allow placement of motor 414 in a variety of locations, such as on the interior surface 409 of the housing structure 402 so as to not interfere or otherwise block the movement of the UUV.

In some examples, motor 414 is bidirectional. In this example, motor 414 may direct rotational movement 411 of the high-friction device 412 in a first direction (e.g., counter-clockwise) to apply the egress translational force 403 to the UUV. In response to one or more control signals, the motor 414 may then direct rotational movement 411 of the high-friction device 412 in a second, opposite direction (e.g., clockwise) to apply the ingress translational force 405 to the UUV.

In another example, one or more of the motorized drive assemblies 404A-404C are independently controllable. In some implementations, the motorized drive assemblies 404A-404C are unidirectional. That is, some of the motorized drive assemblies may be activated to only generate the egress translational force 403 to egress the UUV, while the other motorized drive assemblies are activated to only generate the ingress translational force 405 to ingress the UUV.

Figures 5A, 5B:
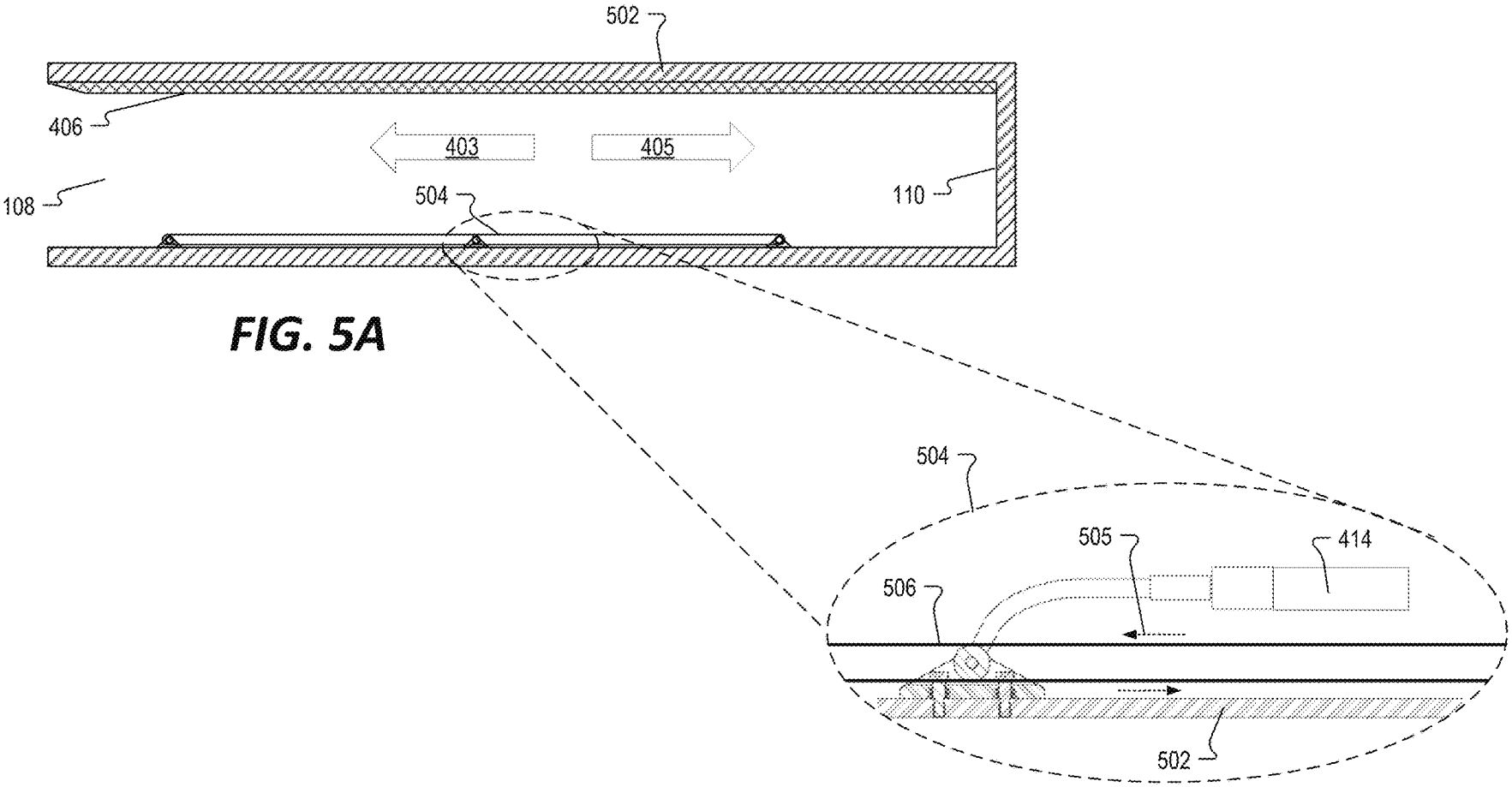
FIG. 5A illustrates an example housing structure of an underwater docking system, in accordance with aspects of the disclosure.
FIG. 5B is an expanded view of the housing structure of FIG. 5A illustrating an example motorized drive assembly that includes a high-friction device, in accordance with aspects of the disclosure.

FIG. 5A illustrates an example housing structure 502 of an underwater docking system, in accordance with aspects of the disclosure. Housing structure 502 is one possible implementation of housing structure 104 of FIGS. 1A-1C and/or housing structure 202 of FIG. 2. Housing structure 502 is shown as including dock aperture 108, closed end 110, a motorized drive assembly 504, and guide rail 406. Housing structure 502 includes similar components and operates similar to housing structure 402 described above, except housing structure 502 includes a high-friction device 506 of motorized drive assembly 504 that is implemented as a high-friction track or belt. In particular, FIG. 5B is an expanded view of the motorized drive assembly 504 that includes high-friction device 506, in accordance with aspects of the disclosure. In some aspects, a high-friction track includes rubber or other material to frictionally contact a surface of the UUV to apply a translational force.

By way of example, motor 414 may direct movement 505 of the high-friction device 506 in a first direction (e.g., to the left, towards dock aperture 108) to apply the egress translational force 403 to the UUV. In addition, motor 414 may also direct movement 505 of the high-friction device 506 in a second, opposite direction (e.g., to the right, towards closed end 110) to apply the ingress translational force 405 to the UUV.

Figure 6:
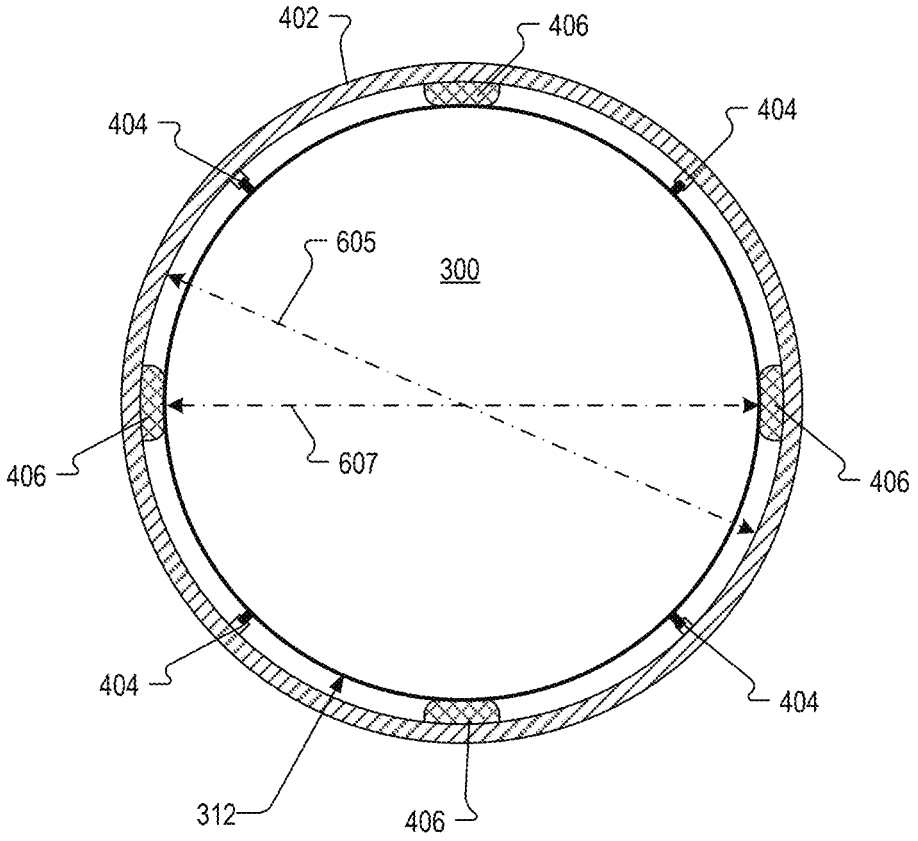
FIG. 6 is an end-view of an UUV housed and partially enclosed within a housing structure, in accordance with aspects of the disclosure.

FIG. 6 is an end-view of UUV 300 housed and partially enclosed within a housing structure 402, in accordance with aspects of the disclosure. The illustrated example of housing structure 402 is shown as including a plurality of guide rails 406 circumferentially disposed on the interior of the housing structure 402 to support and align the UUV 300 within housing structure 402. Although FIG. 6 illustrates housing structure 402 as including four guide rails 406, any number of guide rails may be utilized, including one or more. FIG. 6 also illustrates a plurality of motorized drive assemblies 404 circumferentially disposed on the interior of housing structure 402. As shown in FIG. 6, the motorized drive assemblies 404 are positioned on the interior of housing structure 402 to frictionally engage with the surface 312 of UUV 300.

As mentioned above, size and/or volume constraints may be imposed on housing structure 402 that may create difficulties in moving UUV 300 into and out of the housing structure 402. As shown in FIG. 6, the illustrated example of housing structure 402 is shown as including an interior diameter 605 (e.g., measured from the interior walls of the housing structure 402, not including the radial thickness of guide rails 406). UUV 300 is shown in FIG. 6 as having a maximum outer diameter 607 (measured at exterior surface 312). In one implementation, the outer diameter 607 of UUV 300 is about 16" and the interior diameter 605 of housing structure 402 is about 17.96". This results in a UUV-to-housing structure cross-sectional area ratio of 21% (not including rails) or similarly a housing structure-to-UUV cross sectional area ratio of 26%. In other words, in this particular example, the housing structure 402 has a cross-sectional area that is only 26% larger than the cross-sectional area of UUV 300.

In some aspects, the housing structures discussed herein, may have a maximum cross-sectional area that is at most 26% larger than the cross-sectional area of a respective UUV that is to be housed within. The hydraulic (e.g. piston) effect may be significant at these ratios where the opposite forces imposed against the UUV will increase as this ratio decreases. In yet another example, housing structure 402 may include a cross-sectional area that is at most 10% larger than the cross-sectional area of UUV 300. At such constrained cross-sectional areas, a substantial and prolonged translational force may be required to ingress and/or egress the vehicle, which may necessarily require an impractically high thrust and power requirement if the UUV is attempting to self-propel itself into and out of the housing structure based solely on its own means. Accordingly, aspects of the motorized drive assemblies discussed herein may assist in the ingress and/or egress of a UUV even with the housing structure includes a limited cross-sectional area as discussed above.

Figure 7A:
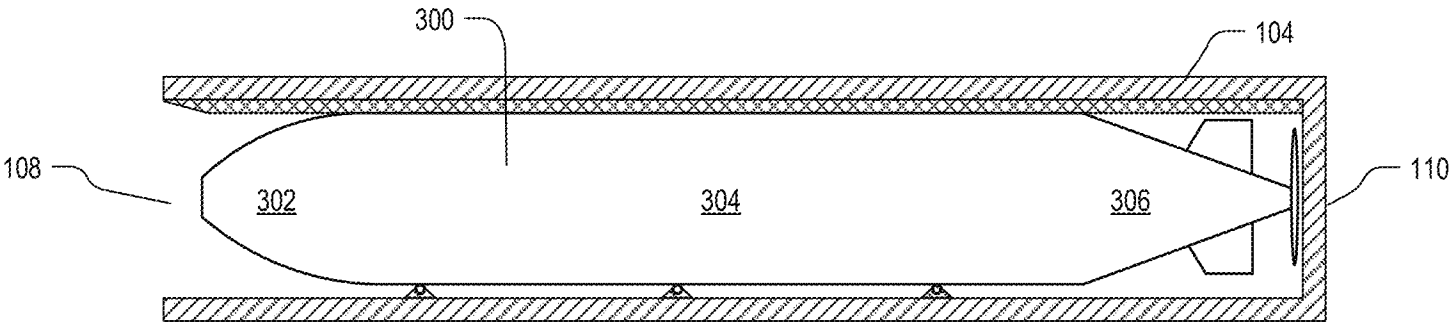
FIG. 7A is a side-view of an UUV housed and partially enclosed within a housing structure in a tail first orientation, in accordance with aspects of the disclosure.

Aspects of the present disclosure may provide a housing structure of an underwater docking system that is configured to house a UUV in a variety of orientations. For example, FIG. 7A is a side-view of UUV 300 housed and partially enclosed within housing structure 104 in a tail first orientation. In the tail first orientation, the aft section 306 of UUV 300 is closest to the closed end 110 of the housing structure, whereas the fore section 302 of UUV 300 is closest to the dock aperture 108. When housed in the tail first orientation, egress of the UUV 300 includes the underwater docking system applying an egress translational force to a surface of the UUV 300 to move the UUV 300 out of the housing structure 104 such that the fore section 302 passes through dock aperture 108 before the other sections (304 and 306) of the UUV 300. When housed in the tail first orientation, the UUV 300 may be unable to self-propel out of the housing structure 104 due to limited water flow, and free space within housing structure 104. Thus, in this example, the underwater docking system may apply the entire egress translational force needed to egress the UUV 300 out of the housing structure 104.

Figure 7B:
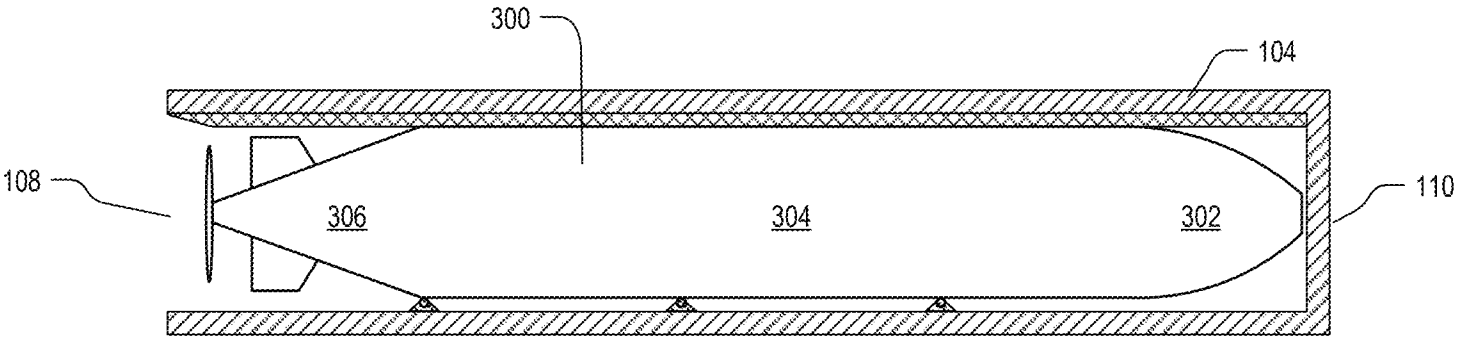
FIG. 7B is a side-view of an UUV housed and partially enclosed within a housing structure in a nose first orientation, in accordance with aspects of the disclosure.

In another example, FIG. 7B illustrates a side-view of UUV 300 housed and partially enclosed within a housing structure in a nose first orientation. In the nose first orientation, the fore section 302 of UUV 300 is closest to the closed end 110 of the housing structure, whereas the aft section 306 of UUV 300 is closest to the dock aperture 108. When housed in the nose first orientation, egress of the UUV 300 includes the underwater docking system applying an egress translational force to a surface of the UUV 300 to move the UUV 300 out of the housing structure 104 such that the aft section 306 passes through dock aperture 108 before the other sections (304 and 302) of the UUV 300. When housed in the nose first orientation, the UUV 300 may be able to self-propel for at least a portion of the egress out of the housing structure 104 due to the propulsor of UUV 300 being exposed to surrounding water. Thus, in this example, the underwater docking system may apply a partial egress translational force combined with any forces imparted by the UUV itself (i.e., self-propulsion) to move the UUV 300 out of the housing structure 104.

As mentioned above, an underwater docking system according to aspects of the present disclosure may also be configured to receive or recover an UUV. Recovery of a UUV into the housing structure 104 may occur in a variety of orientations. For example, FIG. 7A may also illustrate the recovery or ingress of UUV 300 in the tail first orientation. When receiving UUV 300 in the tail first orientation, ingress of the UUV 300 includes the underwater docking system applying an ingress translational force to a surface of the UUV 300 to move the UUV 300 into of the housing structure 104 such that the aft section 306 passes through dock aperture 108 before the other sections (304 and 302) of the UUV 300. When ingressed in the tail first orientation, the UUV 300 may be unable to self-propel into the housing structure 104 due to limited water flow, and free space within housing structure 104. Thus, in this example, the underwater docking system may apply the entire ingress translational force needed to ingress the UUV 300 into the housing structure 104.

By way of another example, FIG. 7B may also illustrate the recovery or ingress of UUV 300 in the nose first orientation. When receiving UUV 300 in the nose first orientation, ingress of the UUV 300 includes the underwater docking system applying an ingress translational force to a surface of the UUV 300 to move the UUV 300 into the housing structure 104 such that the fore section 302 passes through dock aperture 108 before the other sections (304 and 306) of the UUV 300. When ingressed in the nose first orientation, the UUV 300 may be able to self-propel into the housing structure 104 for at least a portion of the ingress. Thus, in this example, the underwater docking system may apply a partial ingress translational force combined with any forces imparted by the UUV itself (i.e., self-propulsion) to move the UUV 300 into the housing structure 104.

Figure 8:
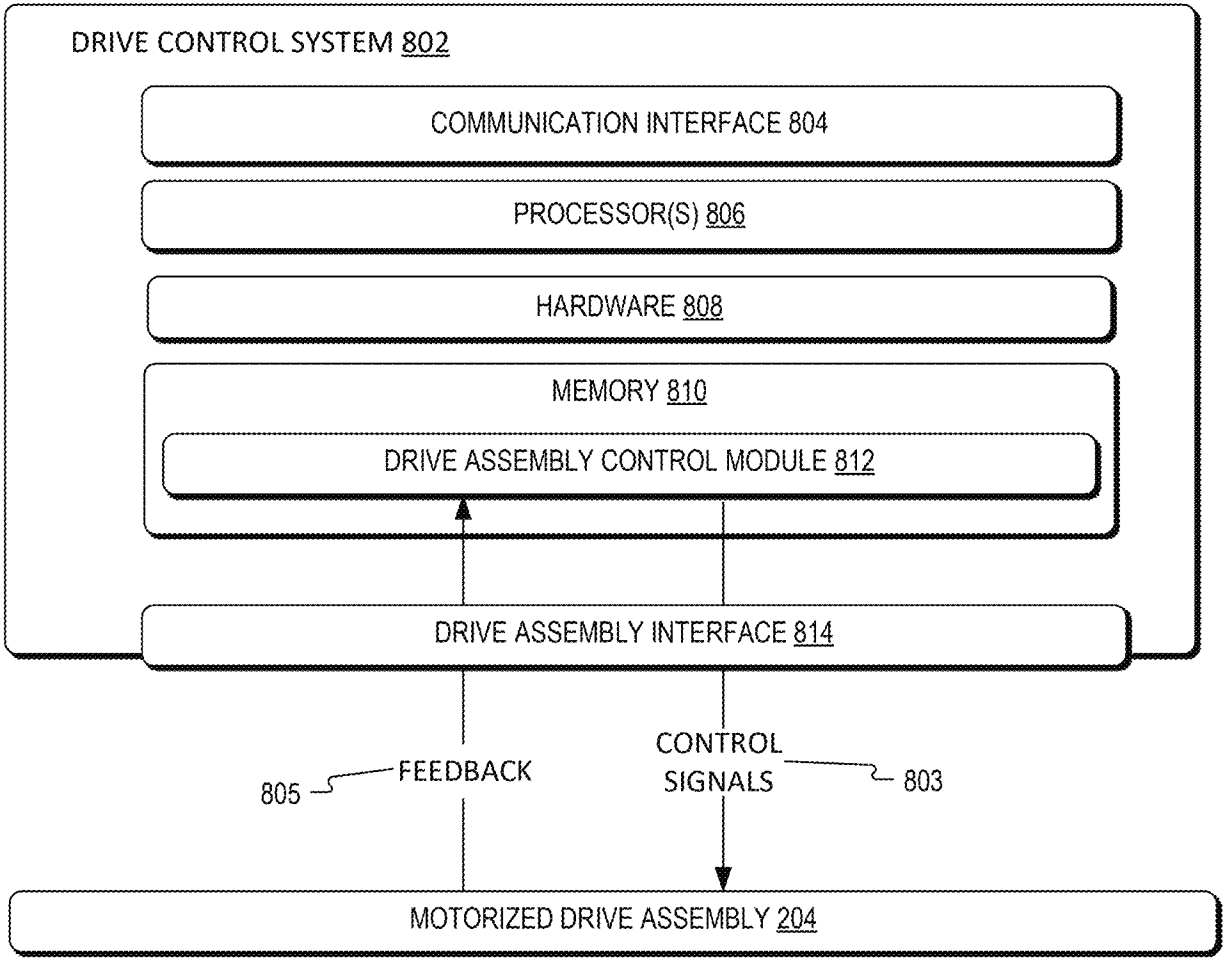
FIG. 8 illustrates an example drive control system, in accordance with aspects of the disclosure.

FIG. 8 illustrates an example drive control system 802, in accordance with aspects of the disclosure. The illustrated example of drive control system 802 is shown as including a communication interface 804, one or more processors 806, hardware 808, a memory 810, and a drive assembly interface 814. Drive control system 802 is one possible implementation of drive control system 206 of FIG. 2.

The communication interface 804 may include wireless and/or wired communication components that enable the drive control system 802 to transmit data to and receive data from other devices, such as the UUV 300 of FIG. 3. The hardware 808 may include additional hardware interface, data communication, or data storage hardware. For example, the hardware interfaces may include a data output device (e.g., electronic display), sensors, and one or more data input devices.

The memory 810 may be implemented using computer-readable media, such as computer storage media. In some aspects, computer-readable media may include volatile and/or non-volatile, removable and/or non-removable media implemented in any method or technology for storage of information such as computer-readable instructions, data structures, program modules, or other data. Computer-readable media includes, but is not limited to, RAM, ROM, EEPROM, flash memory or other memory technology, CD-ROM, digital versatile disks (DVD), high-definition multimedia/data storage disks, or other optical storage, magnetic cassettes, magnetic tape, magnetic disk storage or other magnetic storage devices, or any other non-transmission medium that can be used to store information for access by a computing or drive control system.

The processors 806 and the memory 810 of the drive control system 802 may implement a drive assembly control module 812. The drive assembly control module 812 may include routines, program instructions, objects, and/or data structures that perform particular tasks or implement particular abstract data types. The memory 810 may also include a data store (not shown) that is used by the drive assembly control module 812.

The drive assembly control module 812 may be configured to generate one or more control signals 803 that are communicated to a motorized drive assembly 204 via the drive assembly interface 814. As will be discussed below, drive assembly control module 812 may generate control signals 803 to activate, deactivate, change direction, and/or change speed of one or more motorized drive assemblies included in an underwater docking system, as provided herein. In some examples, drive assembly control module 812 may be configured to independently control each of a plurality of motorized drive assemblies included in the underwater docking system. In some aspects, drive assembly control module 812 may be configured to receive one or more feedback signals 805. The feedback signals 805 may indicate a current limit or load status of one or more motors included in the motorized drive assembly 204.

Figure 9A:
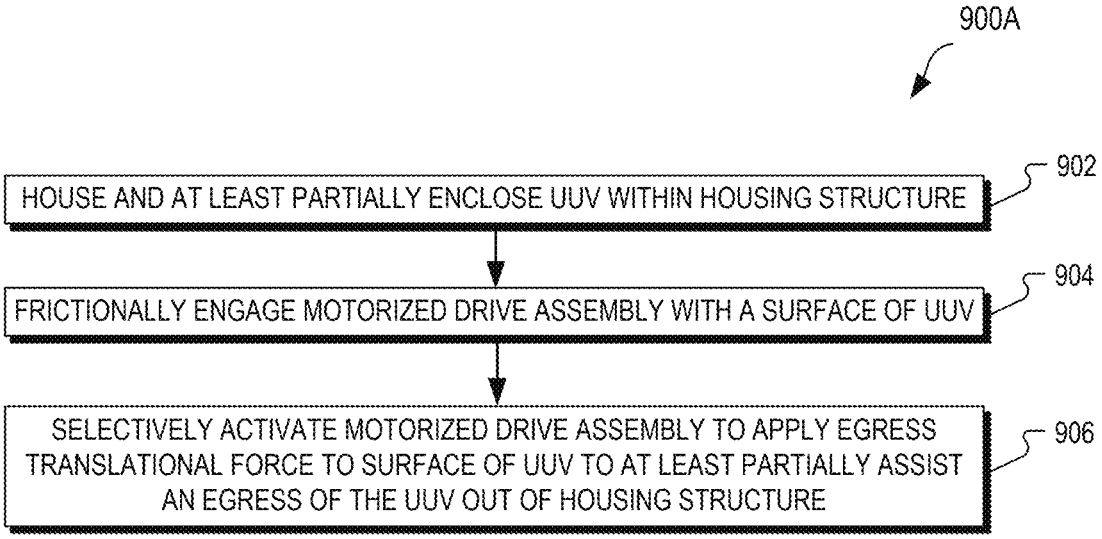
FIG. 9A illustrates an example process of operating an underwater docking system that includes assisted egress of a UUV, in accordance with aspects of the disclosure.

FIG. 9A illustrates an example process 900A of operating an underwater docking system that includes assisted egress of a UUV, in accordance with aspects of the disclosure. Process 900A is one possible process performed by drive control system 206 of FIG. 2 and/or drive control system 802 of FIG. 8. Process 900A will be described with reference to FIGS. 1A, 8, and 9A.

In a process block 902, UUV 106 is housed and at least partially enclosed within housing structure 104. In some examples, UUV 106 is initially installed into housing structure 104 by an operator/user via dock aperture 108 or via an optional hatch included in closed end 110. In other examples, UUV 106 may be initially installed into housing structure 104 via one or more of the recovery/ingress processes describe herein. While housed and enclosed, housing structure 104 may shield and protect UUV 106 from damage and/or may prevent or limit exposure to surrounding water. In some aspects, drive control system 802 may interface with the UUV 106 while UUV 106 is housed within housing structure 104. For example, drive control system 802 may include hardware 808 and drive assembly interface 814 to provide power to the UUV 106 to charge or recharge one or more onboard batteries of UUV 106. In another example, drive control system 802 may establish a communication link (e.g., via drive assembly interface 814) for sending and/or receiving data to/from UUV 106. In yet another example, drive control system 802 may be communicatively coupled (via communication interface 804) to one or more other platforms (e.g., a shore station, a host ship, etc.) for establishing a communication link between UUV 106 and the other platform while housed within housing structure 104.

Referring back to FIG. 9A, process block 904 includes frictionally engaging the motorized drive assembly 204 with a surface of the UUV 106 while the UUV 106 is within housing structure 106. As discussed above housing structure 104, may include one or more high-friction devices (e.g., see high-friction device 412 of FIG. 4B or high-friction device 506 of FIG. 5B) that are positioned on an interior of the housing structure to frictionally engage with a surface (e.g., surface 312 of FIG. 3) of the UUV. As further discussed above with reference to FIG. 4B, in some examples, the motorized drive assembly may include a spring, such as compression spring 422, to provide a positive force between the high-friction device 412 and the UUV.

Next, in process block 906, the drive assembly control module 812 generates one or more control signals 803 to activate the motorized drive assembly 204 to apply the egress translational force 109 to the surface (e.g., surface 312 of FIG. 3) of the UUV 106 to at least partially assist an egress of the UUV 106 out of the housing structure 104. In some examples, the egress translational force 109 applied by the motorized drive assembly 204 is greater than the opposite force 107 imposed against the UUV 106 during the egress. In other examples, UUV 106 may activate on onboard propulsor (e.g., propulsor 310 of FIG. 3) of the UUV during egress, where the egress translational force 109 applied by the motorized drive assembly 204 plus the translational force enacted by the UUV propulsor is greater than the opposite force 107.

In some aspects, drive control system 206 is configured to dynamically determine the opposite force 107 and to generate the one or more control signals 803 to adjust the egress translational force 109 applied by the motorized drive assembly 204. For example, drive control system 802 may be configured to receive information (e.g., via communication interface 804, via memory 810, and/or via drive assembly interface 814) such as UUV weight, surrounding current flow, depth, water salinity, water temperature, etc., that may affect the opposite force 107 and then may adjust the egress translational force 109 in response thereto. In some aspects, UUV available thrust or power, UUV orientation, water viscosity, and/or acceptable ingress/egress times may also be factors considered by the drive control system 802 in dynamically adjusting the translational force 109. In another example, drive control system 206 may receive one or more feedback signals 805 from the motorized drive assembly 204 during egress that indicates the current load on one or more motors and/or an egress speed/progress of the UUV and then may adjust the egress translational force 109 in response thereto. In some examples, adjusting the egress translational force 109 includes adjusting a speed and/or torque of one or more motors included in the motorized drive assembly 204. In another example, adjusting the egress translational force 109 includes increasing or decreasing the number of motorized drive assemblies that are activated.

Figure 9B:
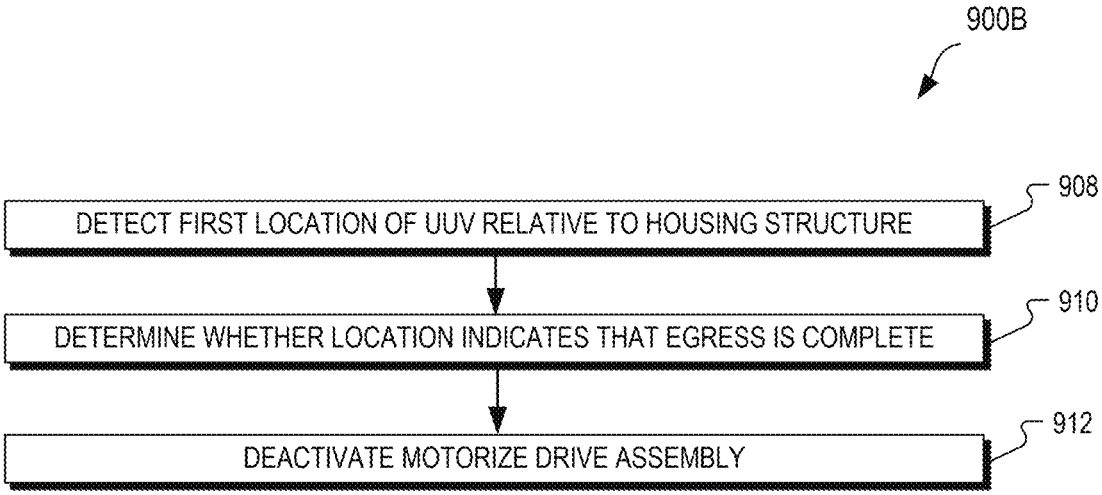
FIG. 9B illustrates an example process of operating an underwater docking system that includes detecting a location of a UUV and deactivating a motorized drive assembly, in accordance with aspects of the disclosure.

FIG. 9B illustrates an example process 900B of operating an underwater docking system that includes detecting a location of a UUV and deactivating a motorized drive assembly, in accordance with aspects of the disclosure. Process 900B is one possible process performed by drive control system 206 of FIG. 2 and/or drive control system 802 of FIG. 8. Process 900B will be described with reference to FIGS. 1A, 8, and 9B.

In a process block 908, drive assembly control module 812 detects a location of UUV 106 relative to the housing structure 104 during egress. In some examples, drive control system may include one or more sensors that are configured to detect the location of the UUV. For example, drive control system 802 may include communication interface 804 that is communicatively coupled to receive one or more signals from UUV 106, where the signals indicate that egress is complete, that UUV 106 is no longer within the housing structure 104, and/or that the egress translational force 109 is no longer needed. In another example, the hardware 808 of drive control system 802 may include a camera that is coupled to the housing structure 104 to capture one or more images of the UUV 106. In this example, drive assembly control module 812 may present the images to an operator to determine a location of the UUV relative to the housing structure 104 and/or the drive assembly control module 812 may analyze the images itself to determine the UUV location. In yet another example, drive assembly control module 812 may receive one or more feedback signals 805 indicating a current load on one or more motors included in the motorized drive assembly 204. For example, a drop in the current load on one or more motors may indicate that the UUV 106 is no longer in frictional contact with the motorized drive assembly and that egress is complete or at least partially completed.

Next, in process block 910, the drive assembly control module 812 determines whether egress is complete. As mentioned above, the drive assembly control module 812 may determine that egress is complete by utilizing one or more sensors, as discussed above, to determine a location of the UUV relative to the housing structure 104. If the location of the UUV indicates that egress is complete, then process block 906 includes the drive assembly control module 812 deactivating the motorized drive assembly 204.

Figure 10:
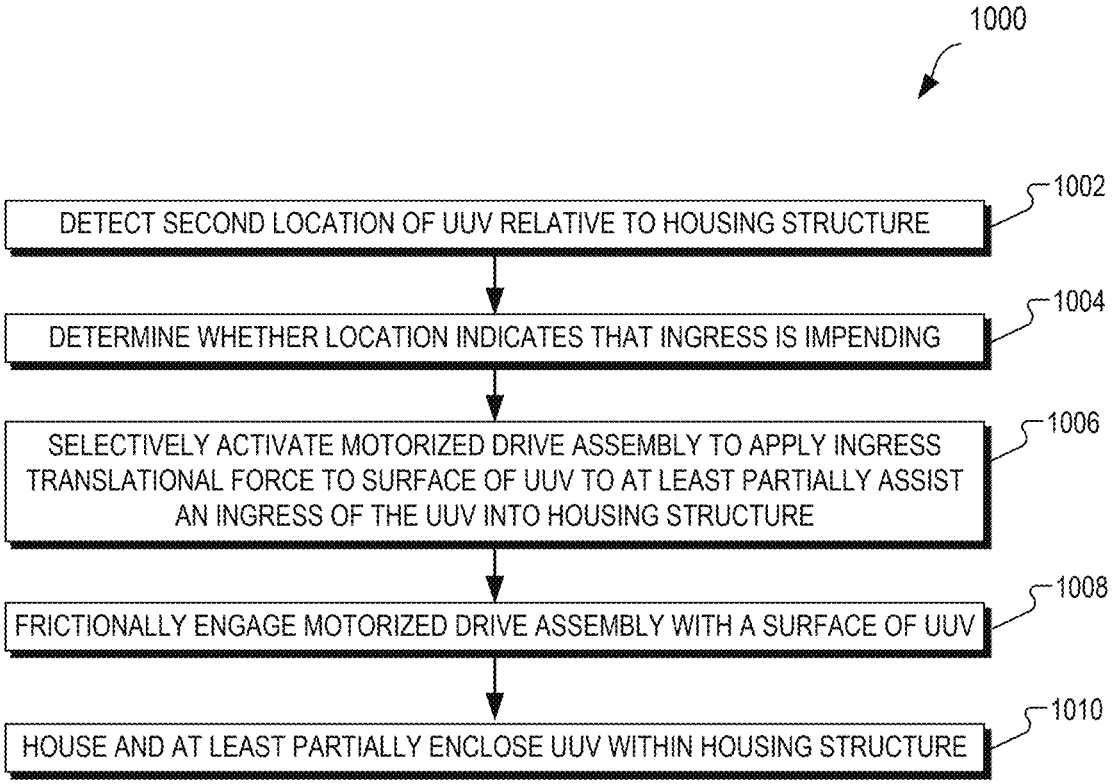
FIG. 10 illustrates an example process of operating an underwater docking system that includes assisted ingress of a UUV, in accordance with aspects of the disclosure.

The processes describe above with reference to FIGS. 9A and 9B illustrate examples of assisted or partially-assisted egress of a UUV. In some aspects, an underwater docking system, as discussed herein may also include assisted or partially assisted ingress of the UUV into the housing structure. For example, FIG. 10 illustrates an example process 1000 of operating an underwater docking system that includes assisted ingress of a UUV, in accordance with aspects of the disclosure. Process 1000 is one possible process performed by drive control system 206 of FIG. 2 and/or drive control system 802 of FIG. 8. Process 1000 will be described with reference to FIGS. 1B, 8, and 10.

In a process block 1002, the drive assembly control module 812 determines a location of UUV 106 relative to the housing structure 104. As mentioned above, the drive assembly control module 812 may determine a location of the UUV by utilizing one or more sensors. Next, in a process block 1004, the drive assembly control module 812 determines whether the location of the UUV indicates that an ingress is impending and if so, process block 1006 includes the drive assembly control module generating one or more control signals 803 to selectively activate the motorized drive assembly 204 to apply the ingress translational force 111 to the surface (e.g., surface 312 of FIG. 3) of the UUV to at least partially assist an ingress of the UUV 106 into the housing structure 104.

In some examples, the ingress translational force 111 applied by the motorized drive assembly 204 is greater than the opposite force 113 imposed against the UUV 106 during the ingress. In other examples, UUV 106 may activate on onboard propulsor (e.g., propulsor 310 of FIG. 3) of the UUV during ingress, where the ingress translational force 111 applied by the motorized drive assembly 204 plus the translational force enacted by the UUV propulsor is greater than the opposite force 113. In some aspects, drive control system 206 is configured to dynamically determine the opposite force 113 and to generate the one or more control signals 803 to adjust the ingress translational force 109 applied by the motorized drive assembly 204.

Process block 1008 includes frictionally engaging the motorized drive assembly 204 with a surface of the UUV 106 while the UUV 106 is being ingressed into the housing structure 104. As discussed above, housing structure 104, may include one or more high-friction devices (e.g., see high-friction device 412 of FIG. 4B or high-friction device 506 of FIG. 5B) that are positioned on an interior of the housing structure to frictionally engage with a surface (e.g., surface 312 of FIG. 3) of the UUV. As further discussed above with reference to FIG. 4B, in some examples, the motorized drive assembly may include a spring, such as compression spring 422, to provide a positive force between the high-friction device 412 and the UUV. While frictionally engaged with the surface of the UUV 106, movement of the high-friction devices (e.g., rotational movement 411 of FIG. 4B or movement 505 of FIG. 5B) translates to the ingress translational force 111 that is applied to the surface of the UUV 106.

Next, in a process block 1010, the drive assembly control module 812 determines whether ingress is complete (e.g., based on determining a location of the UUV, or other trigger), and if so the drive assembly control module 812 deactivates the motorized drive assembly 204. Thus, once ingress is completed, the UUV 106 is housed and at least partially enclosed within the housing structure 104.

Figure 11A:
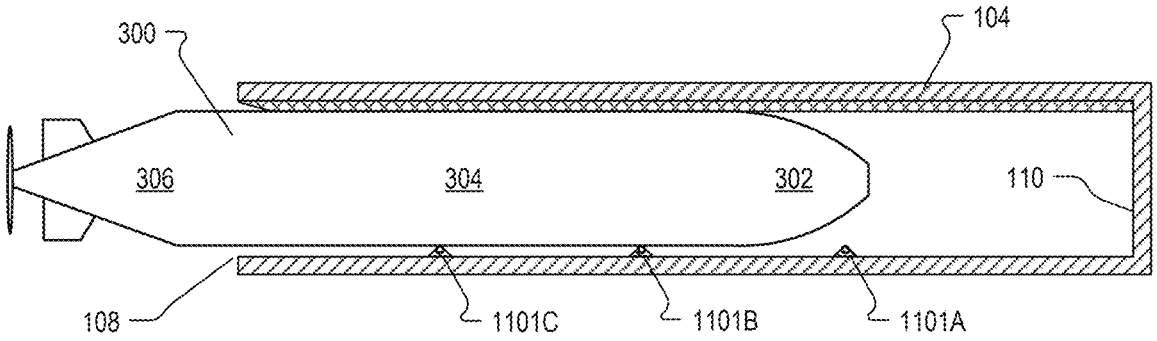
FIG. 11A illustrates an example of a partial egress or a partial ingress of a UUV, in accordance with aspects of the disclosure.
Figure 11B:
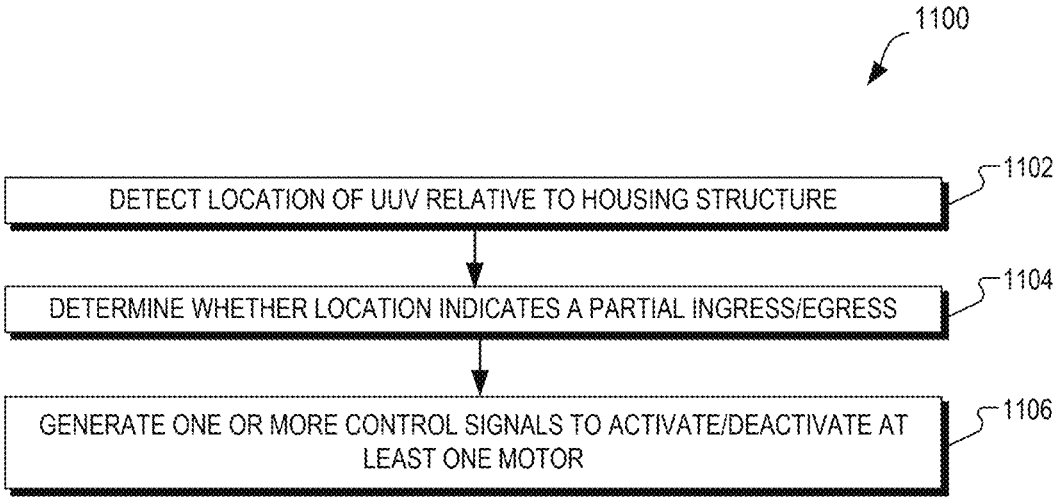
FIG. 11B illustrates an example process of operating an underwater docking system, in accordance with aspects of the disclosure.

FIG. 11A illustrates an example of a partial egress and/or a partial ingress of a UUV 300, in accordance with aspects of the disclosure. FIG. 11B illustrates an example process 1100 of operating an underwater docking system, in accordance with aspects of the disclosure. Process 1100 is one possible process performed by drive control system 206 of FIG. 2 and/or drive control system 802 of FIG. 8. Process 1100 will be described with reference to FIGS. 8, 11A, and 11B.

In a process block 1102, the drive assembly control module 812 determines a location of the UUV 300 relative to the housing structure 104. As mentioned above, the drive assembly control module 812 may determine a location of the UUV 300 by utilizing one or more sensors.

Next, in a process block 1104, the drive assembly control module 812 determines whether the location of the UUV 300 indicates a partial ingress/egress. In particular, drive assembly control module 812 may be configured to determine a partial ingress of the UUV 300 during an ingress operation and/or may be configured to determine a partial egress of the UUV 300 during an egress operation. A partial ingress and partial egress refers to a situation where some of the UUV 300 is outside the housing structure 104 while a remaining portion of the UUV 300 remains inside the housing structure 104. In the illustrated example of FIG. 11A, aft section 306 is outside the housing structure 104, where middle section 304 and fore section 302 remain inside the housing structure 104. In another example, a partial ingress or partial egress may include the fore section 302 being outside the housing structure 104 while the aft section 306 is inside the housing structure 104.

Next, in a process block 1106, the drive assembly control module 812 generates one or more control signals 803 to activate/deactivate at least one motor of a corresponding motorized drive assembly 1101A-1101C in response to determining the partial ingress/egress. For example, during an egress of UUV 300, drive assembly control module 812 determines a partial egress as shown in FIG. 11A. As shown in FIG. 11A, the motorized drive assembly 1101A is no longer in frictional contact with the UUV 300 and thus, the drive assembly control module 812 may deactivate the motorized drive assembly 1101A, while keeping motorized drive assemblies 1101B and 1101C engaged to continue applying the egress translational force. In some aspects, the drive assembly control module 812 may continue sequentially deactivating motorized drive assemblies as the UUV 300 continues to egress (e.g., deactivate motorized drive assembly 1101A, then deactivate motorized drive assembly 1101B, then deactivate motorized drive assembly 1101C, etc.).

By way of another example, with reference to FIG. 11A, during an ingress of UUV 300, the motorized drive assembly 1101A is not yet in frictional contact with the UUV 300 and thus, drive assembly control module 812 may keep motorized drive assembly 1101A deactivated until the motorized drive assembly 1101A is indeed in contact with the surface of UUV 300. In some aspects, the drive assembly control module 812 may sequentially activate motorized drive assemblies as the UUV 300 ingresses into the housing structure 104 (e.g., activate motorized drive assembly 1101C, then activate motorized drive assembly 1101B, then activate motorized drive assembly 1101A, etc.).

As discussed above, UUV 300 may include a propulsor for providing at least some of the translational forces for ingress and/or egress into or out of housing structure 104. Accordingly, in some aspects, drive assembly control module 812 may be configured to place one or more of the motorized drive assemblies in a neutral state in response to determining the partial ingress/egress. For example, assuming FIG. 11A illustrates a partial egress of UUV 300, where a propulsor of UUV 300 is able to provide a remaining egress translational force, one or more of the motorized drive assemblies 1101A-1101C may be placed in the neutral state to allow UUV 300 to complete egress entirely on its own power (i.e., without assistance from motorized drive assemblies 1101A-1101C). In some aspects, the neutral state includes one or more of the high-friction devices (e.g., high-friction rollers or high-friction track) being freely rotatable. In some examples, the high-friction devices are only freely rotatable in the egress direction (i.e., towards the dock aperture to allow UUV 300 to move out of the housing structure 104).

By way of another example, assuming FIG. 11A illustrates a partial ingress of UUV 300, where a propulsor of UUV 300 is able to provide an initial ingress translational force, one or more of the motorized drive assemblies 1101A-1101C may be placed in the neutral state to allow UUV 300 to initially ingress on its own power (i.e., without assistance from motorized drive assemblies 1101A-1101C). In some aspects, the neutral state includes one or more of the high-friction devices (e.g., high-friction rollers or high-friction track) being freely rotatable. In some examples, the high-friction devices are only freely rotatable in the ingress direction (i.e., towards the closed end 110 to allow UUV 300 to move into the housing structure 104). Thus, in some aspects, one or more of the motorized drive assemblies 1101A-1101C may remain in the neutral state until the UUV 300 is no longer able to effectively ingress on its own, at which time the drive assembly control module 812 may generate control signals 803 to activate one or more of the motorized drive assemblies 1101A-1101C to begin applying an ingress translational force to assist in the ingress of UUV 300.

The processes, methods, functions, or modules explained above may be implemented in hardware, software, firmware, or any combination thereof. If implemented in software, the techniques may be stored on or transmitted as one or more instructions or code on a computer-readable medium. The techniques described may constitute computer-executable instructions embodied or stored within a tangible or non-transitory computer-readable medium, that when executed by a processor will cause the processor to perform the operations or acts described. Additionally, the processes may be embodied within hardware, such as an application specific integrated circuit ("ASIC") or otherwise.

A tangible non-transitory computer-readable medium includes any mechanism that provides (i.e., stores) information in a form accessible by a machine (e.g., a computer, network device, personal digital assistant, manufacturing tool, any device with a set of one or more processors, etc.). For example, a machine-readable medium may include recordable or non-recordable media (e.g., read only memory (ROM), random access memory (RAM), magnetic disk storage media, optical storage media, flash memory devices, etc.).

In addition, the methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various modifications are possible within the scope of the invention, as those skilled in the relevant art will recognize.

These modifications can be made to the invention in light of the above detailed description. The terms used in the following claims should not be construed to limit the invention to the specific embodiments disclosed in the specification. Rather, the scope of the invention is to be determined entirely by the following claims, which are to be construed in accordance with established doctrines of claim interpretation.

What is claimed is:

1. An underwater docking system for an unmanned underwater vehicle (UUV), the underwater docking system comprising:

a housing structure configured to at least partially enclose and house the UUV;

a motorized drive assembly disposed on an interior of the housing structure and positioned to frictionally engage with a surface of the UUV when the UUV is within the housing structure; and a drive control system configured to selectively activate the motorized drive assembly to apply an egress translational force to the surface of the UUV to at least partially assist an egress of the UUV out of the housing structure.

2. The underwater docking system of claim 1, wherein the egress translational force applied by the motorized drive assembly is greater than an opposite force imposed against the UUV during the egress, wherein the opposite force includes at least one of: a hydrodynamic force, a frictional force, and a hydraulic force.

3. The underwater docking system of claim 2, wherein the drive control system is configured to dynamically determine the opposite force and to generate one or more control signals to adjust the egress translational force applied by the motorized drive assembly in response thereto.

4. The underwater docking system of claim 1, wherein the UUV includes a propulsor that is activated during the egress for propelling the UUV, wherein the egress translational force applied by the motorized drive assembly plus a translational force enacted by the UUV propulsor is greater than an opposite force imposed against the UUV during the egress, wherein the opposite force includes at least one of: a hydrodynamic force, a frictional force, and a hydraulic force.

5. The underwater docking system of claim 1, wherein the housing structure has a size-constrained volume that limits or prevents self-propulsion of the UUV within the housing structure.

6. The underwater docking system of claim 1, wherein the housing structure is to be disposed within a water-obstructed medium that prevents or restricts a free-flow of water in or surrounding the housing structure.

7. The underwater docking system of claim 1, wherein the motorized drive assembly comprises:

at least one motor; and a high-friction device coupled to the at least one motor and positioned to frictionally engage with the surface of the UUV, wherein the drive control system is configured to generate one or more control signals to activate the at least one motor to direct the high-friction device to apply the egress translational force.

8. The underwater docking system of claim 7, wherein the high-friction device comprises one or more high-friction tracks.

9. The underwater docking system of claim 7, wherein the high-friction device comprises one or more high-friction rollers.

10. The underwater docking system of claim 9, wherein the drive control system further comprises:

one or more sensors configured to detect a location of the UUV relative to the housing structure, wherein the drive control system is configured to generate one or more control signals to deactivate the at least one motor in response to the location of the UUV.

11. The underwater docking system of claim 10, wherein the location detected by the one or more sensors indicates a partial egress of the UUV, and wherein the drive control system is further configured to generate the one or more control signals to deactivate the at least one motor in response to the location indicating the partial egress.

12. The underwater docking system of claim 11, wherein drive control system is configured to place the one or more high-friction rollers in a neutral state in response to the location indicating the partial egress, wherein the neutral state includes the one or more high-friction rollers being freely rotatable at least in an egress direction.

13. The underwater docking system of claim 10, wherein the one or more sensors comprise at least one of: a current limit switch coupled to the at least one motor, a camera coupled to the housing structure to capture one or more images of the UUV, or a communication interface communicatively coupled to receive one or more signals from the UUV.

14. The underwater docking system of claim 1, wherein the drive control system is further configured to selectively activate the motorized drive assembly to apply an ingress translational force to the surface of the UUV to at least partially assist an ingress of the UUV into the housing structure.

15. A method of operating an underwater docking system for an unmanned underwater vehicle (UUV), the method comprising:

housing and at least partially enclosing the UUV with a housing structure;

frictionally engaging a motorized drive assembly with a surface of the UUV when the UUV is within the housing structure; and selectively activating the motorized drive assembly to apply an egress translational force to the surface of the UUV to at least partially assist an egress of the UUV out of the housing structure.

16. The method of claim 15, further comprising:

dynamically adjusting the egress translational force applied by the motorized drive assembly to be greater than an opposite force imposed against the UUV during the egress, wherein the opposite force includes at least one of: a hydrodynamic force, a frictional force, and a hydraulic force.

17. The method of claim 15, further comprising:

detecting a first location of the UUV relative to the housing structure during the egress;

determining whether the location indicates that the egress is complete; if so deactivating the motorized drive assembly;

detecting a second location of the UUV relative to the housing structure;

determining whether the location indicates that an ingress of the UUV is impending; and if so activating the motorized drive assembly to apply an ingress translational force to the surface of the UUV to at least partially assist the ingress of the UUV into of the housing structure.

18. An underwater docking system for an unmanned underwater vehicle (UUV), the underwater docking system comprising:

a housing structure configured to at least partially enclose and house the UUV;

a motorized drive assembly disposed on an interior of the housing structure and positioned to frictionally engage with a surface of the UUV when the UUV is within the housing structure; and a drive control system that includes:

at least one processor; and at least one memory coupled to the at least one processor, the at least one memory having instructions stored therein, which when executed by the at least one processor, direct the drive control system to:

selectively activate the motorized drive assembly to apply an egress translational force to the surface of the UUV to at least partially assist an egress of the UUV out of the housing structure.

19. The underwater docking system of claim 18, wherein the at least one memory further includes instructions, which when executed by the at least one processor, direct the drive control system to:

dynamically adjust the egress translational force applied by the motorized drive assembly to be greater than an opposite force imposed against the UUV during the egress, wherein the opposite force includes at least one of: a hydrodynamic force, a frictional force, and a hydraulic force.

20. The underwater docking system of claim 18, wherein the at least one memory further includes instructions, which when executed by the at least one processor, direct the drive control system to:

detect a first location of the UUV relative to the housing structure during the egress;

determine whether the location indicates that the egress is complete; if so deactivate the motorized drive assembly;

detect a second location of the UUV relative to the housing structure;

determine whether the location indicates that an ingress of the UUV is impending; and if so activate the motorized drive assembly to apply an ingress translational force to the surface of the UUV to at least partially assist the ingress of the UUV into of the housing structure.

* * * * *